US007107658B2

(12) United States Patent
Müller

(10) Patent No.: US 7,107,658 B2
(45) Date of Patent: Sep. 19, 2006

(54) APPARATUS FOR NEEDLING A NON-WOVEN MATERIAL

(75) Inventor: Karl Müller, Wels (AT)

(73) Assignee: Textilmaschinenfabrik Dr. Ernst Fehrer Aktiengesellscaft, Leonding (AT)

( * ) Notice: Subject to any disclaimer, the term of this patent is extended or adjusted under 35 U.S.C. 154(b) by 0 days.

(21) Appl. No.: 11/082,774

(22) Filed: Mar. 17, 2005

(65) Prior Publication Data

US 2005/0217093 A1 Oct. 6, 2005

(30) Foreign Application Priority Data

Mar. 31, 2004 (AT) ..... A 570/2004

(51) Int. Cl.
*D04H 18/00* (2006.01)

(52) U.S. Cl. ..... 28/114

(58) Field of Classification Search ..... 28/114, 28/107, 108, 109, 110, 111, 112, 113, 115; 112/80.4, 80.41, 80.42
See application file for complete search history.

(56) References Cited

U.S. PATENT DOCUMENTS 3,849,845 A * 11/1974 Obenaus ..... 28/107
4,891,870 A * 1/1990 Muller ..... 28/107
5,548,881 A * 8/1996 Ludwig ..... 28/114
5,873,152 A * 2/1999 Jourde et al. ..... 28/107
6,000,112 A 12/1999 Öllinger et al.
6,266,856 B1 * 7/2001 Fehrer et al. ..... 28/107
6,305,058 B1 * 10/2001 Fehrer ..... 28/107
6,481,071 B1 * 11/2002 Fehrer et al. ..... 28/107
6,568,051 B1 * 5/2003 Legl et al. ..... 28/114
6,584,659 B1 * 7/2003 Legl et al. ..... 28/114
6,785,940 B1 * 9/2004 Muller ..... 28/114
2002/0162203 A1 * 11/2002 Legl et al. ..... 28/114

FOREIGN PATENT DOCUMENTS

DE 199 10 945 10/1999

* cited by examiner

*Primary Examiner*—Amy B. Vanatta
(74) *Attorney, Agent, or Firm*—Collard & Roe, P.C.

(57) ABSTRACT

An apparatus for needling a non-woven material is described, comprising at least one needleboard (1) which is drivable in a reciprocating manner in the needle-penetration direction (6) as well as in the direction of the passage (11) of the non-woven material, comprising an eccentric drive for the needleboard (1) which comprises two parallel eccentric shafts (2, 3) which are drivable in opposite directions and assume a different angular position (ϕ), and couplers (5) which connect the connecting rods (4) of the two eccentric shafts (2, 3) in an articulated manner and comprise a guide arm (8) which is rigidly connected with the same, and a lifting guide means (9) for the guide arms (8) which forms a swiveling axis (10) for the guide arms (8) which is parallel to the eccentric shafts (2, 3). In order to provide advantageous constructional conditions it is proposed that either the guide arms or the couplers carry the needleboard.

3 Claims, 2 Drawing Sheets

APPARATUS FOR NEEDLING A NON-WOVEN MATERIAL

FIELD OF THE INVENTION

The invention relates to an apparatus for needling a non-woven material with at least one needleboard which is drivable in a reciprocating manner in the needle-penetration direction as well as in the direction of the passage of the non-woven material, comprising an eccentric drive for the needleboard which comprises two parallel eccentric shafts which are drivable in opposite directions and assume a different angular position, and couplers which connect the connecting rods of the two eccentric shafts in an articulated manner and comprise a guide arm which is rigidly connected with the same, and a lifting guide means for the guide arms which forms a swiveling axis for the guide arms which is parallel to the eccentric shafts.

DESCRIPTION OF THE PRIOR ART

In order to increase the advance of the non-woven material at a compact construction it is known (DE 199 10 945 A1) to link the needleboard to an eccentric drive via push rods which are each displaceably held in a guide sleeve, which eccentric drive consists of two parallel eccentric drives which are drivable in opposite directions and are provided with connecting rods, with the guide sleeves being swivelably held about an axle extending parallel to the eccentric shafts, so that the guide sleeves can be swiveled for an additional drive of the needleboard in the direction of advance of the non-woven material. A further eccentric drive is used for driving the guide sleeves, which eccentric drive comprises on its part two eccentric shafts. The connecting rods of said eccentric shafts are connected to a coupler, to which a guide arm is linked which is rigidly connected with the guide sleeves. Since the stroke of the point of articulation of the guide arm on the coupler depends on the coupling movement and thus the mutual phase position of the two eccentric shafts in the case of given eccentricities, the swiveling stroke for the guide sleeves can be set via a device for adjusting the mutual angular position of the eccentric shafts. Despite the possibility achieved by this construction to keep the connecting rods of the eccentric drive short for the needleboard movement in the direction of advance of the non-woven material and thus to house said eccentric drive in a common housing with the main drive, there is a respective amount of constructional effort involved in the additional eccentric drive for driving the needleboard in the direction of advance of the non-woven material.

It has already been proposed for simplifying construction to drive the needleboard via push rods which are linked to an eccentric drive and are each displaceably held in a swivelable guide sleeve. The connecting rods of the two eccentric shafts of the eccentric drive extend inclined with respect to each other and the eccentric shafts per se assume a different angular position. As a result of the mutually inclined course of the connecting rods, the needleboard can be driven along an inherently closed orbit as a result of a phase displacement between the two eccentric shafts if a respective restricted guidance of the connecting rods is ensured. This restricted guidance is achieved in the arrangement of a single needleboard in such a way that the connecting rods act upon the push rods via coaxial link axles. If two needleboards are provided which are arranged behind one another in the direction of advance of the non-woven material and which are each driven through a common eccentric drive via push rods guided in swivelable guide sleeves, the push rods of the two needleboards are connected by a coupler on which the connecting rods of the eccentric rods act. The coupler needs to be guided additionally, which occurs in a swivelable lifting guide. In addition to the lifting movement, this allows swiveling the coupler about a middle position extending in the direction of needle penetration and thus leads to the additional drive movement of the needleboards in the direction of passage of the non-woven material. The inclination of the connecting rods which is mandatory for the movement component of the needleboard in the direction of passage of the non-woven material leads to a comparatively high eccentricity for the predetermined stroke of the needleboard in the direction of needle penetration. Moreover, there is a considerable construction effort required especially for the arrangement of two needleboards.

SUMMARY OF THE INVENTION

The invention is thus based on the object of providing an apparatus for needling a non-woven material of the kind mentioned above with simple constructional means in such a way that the eccentricity of the eccentric shafts can be used advantageously for the stroke of the needleboard in the direction of the needle penetration without having to make use of a separate needleboard drive in the direction of passage of the non-woven material.

This object is achieved by the invention in such a way that either the guide arms or the couplers carry the needleboard. Since in the case of a guidance of the guide arms of the couplers which connect the connecting rods of the two eccentric shafts in a lifting guide forming a swiveling axis for the guide arms the couplers are displaced in a reciprocating manner not only along the lifting guide in the direction of the needle penetration but are also swiveled about the swiveling axis of the lifting guide independent of any mutual inclination of the connecting rods when the two eccentric shafts of the eccentric drive have a different angular position (i.e. a phase displacement), the eccentricity of the two eccentric shafts can be utilized at least to a substantial extent for the needle stroke. The throw of the couplers about the swiveling axis of the lifting guide means depends not only on the mutual rotational adjustment of the two eccentric shafts, but also on the respective lever conditions and can be influenced especially by the distance of the couplers from the swiveling axes of the associated lifting guide means. It is thus possible to omit conventional push rods for the guidance of the needleboards in a constructionally simple manner and to use the couplers or the guide arms as supports for the needleboard in order to enable its driving both in the direction of needle penetration and in the direction of passage of the non-woven material.

If only a single needleboard is provided, then it is recommended to extend the guide arm which is provided on the side of the couplers averted from the connecting rods beyond the lifting guide means, so that the needleboard (as is commonly the case with push rods) can be fastened to the free ends of the guide arms of the couplers via a needleboard beam.

If two needleboards are provided which are arranged behind one another in the direction of passage of the non-woven material, then these needleboards can be arranged on the side of the couplers which is averted from the connecting rods and the guide arms, so that the couplers per se act as supports for the needleboards.

BRIEF DESCRIPTION OF THE DRAWINGS

The subject matter of the invention is shown by way of example in the drawings, wherein.

DESCRIPTION OF THE PREFERRED EMBODIMENTS

Figure 1:
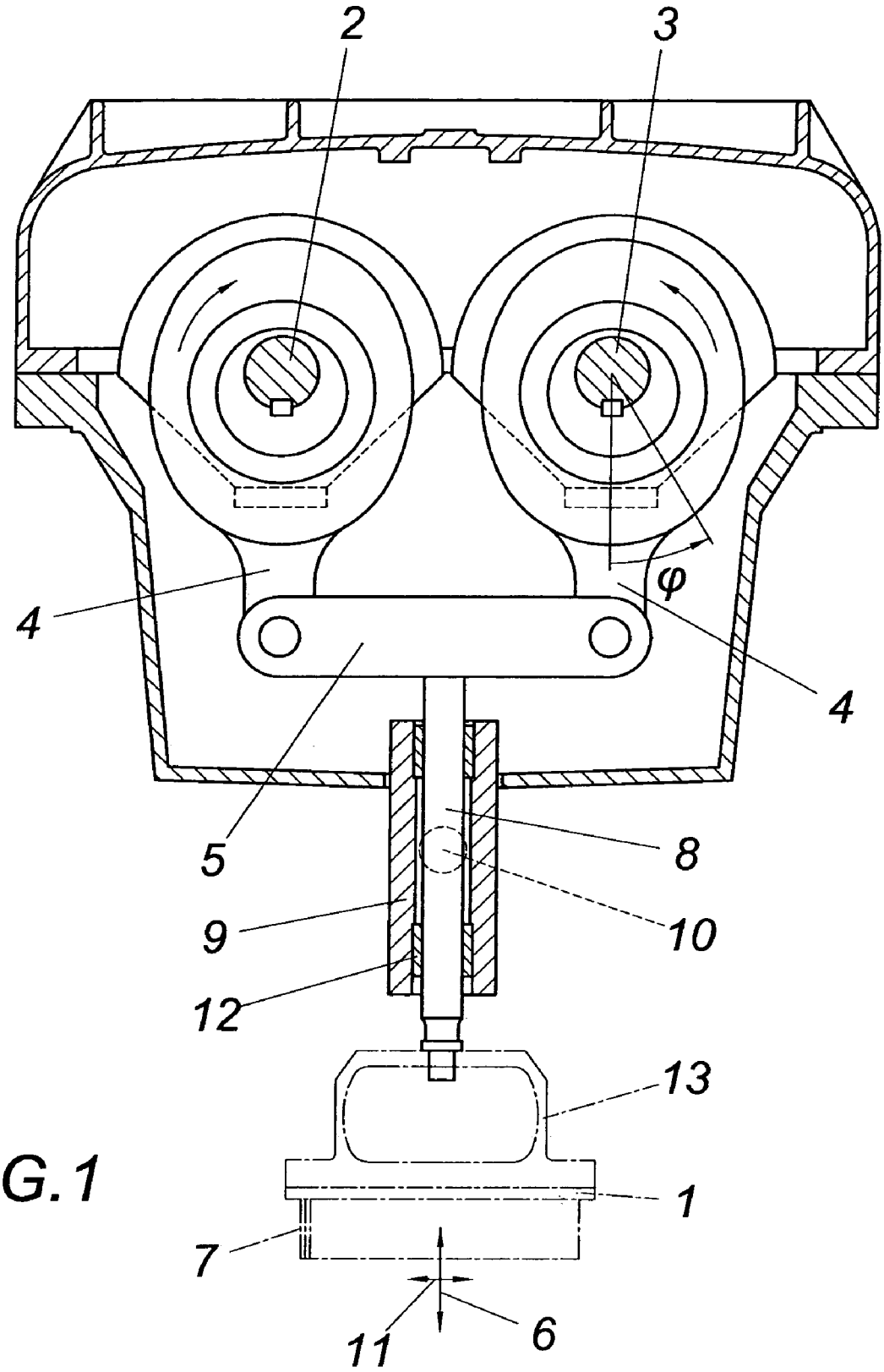
FIG. 1 shows an apparatus in accordance with the invention for needling a non-woven material for a needleboard in a simplified sectional view perpendicular to the eccentric shafts.
Figure 2:
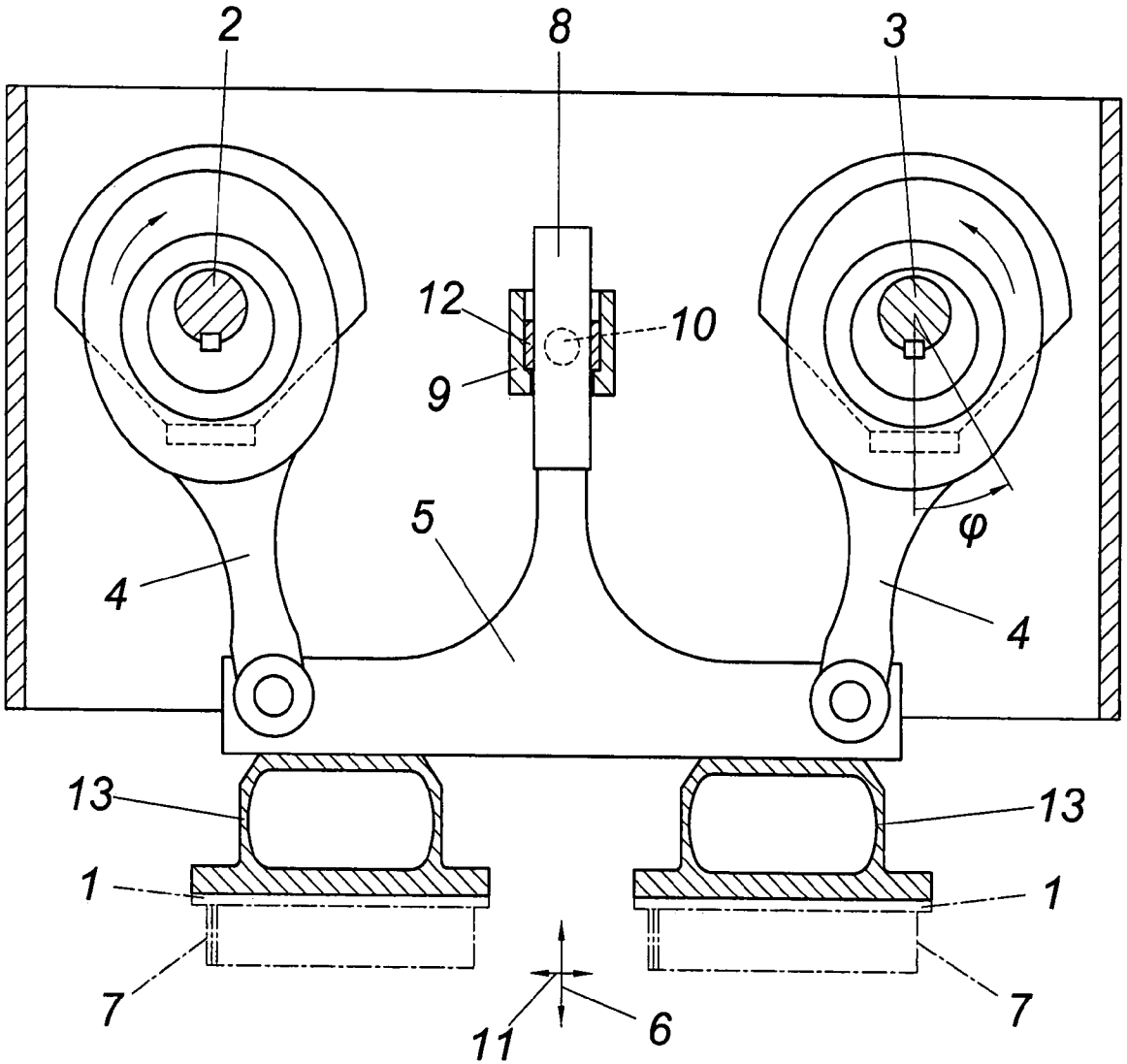
FIG. 2 shows a representation corresponding to FIG. 1 of a constructional variant with two needleboards.

As can be seen from the embodiments according to FIGS. 1 and 2, the eccentric drive for driving at least one needleboard 1 of a needling apparatus for a non-woven material comprises two eccentric shafts 2 and 3 whose connecting rods 4 are each connected in an articulated manner via a coupler 5 which comprises a guide arm 8 which is rigidly connected with the same and extends in the direction of penetration 6 of the needles 7. This guide arm 8 engages in a lifting guide means 9 which is held in a pivoting manner about an axle 10 which is parallel to the eccentric shafts 2, 3 and extends in the plane of symmetry between the eccentric shafts 2, 3. As a result of this lifting guide means 9, the position of the four-bar mechanism is determined unequivocally from the connecting rods 4 and the connecting couplers 5, so that after a rotational adjustment of the eccentric shaft 3 relative to the eccentric shaft 2 by a phase angle $\phi$ it is not only the lifting position that changes but also the angular position of the couplers 5 during a revolution of the eccentric shafts 2, 3. This can be used for driving a needleboard 1 both in the direction of needle penetration 6 as well as in the direction of passage of the non-woven material.

For this purpose, the guide arms 8 are provided according to FIG. 1 on the side of the couplers 5 which are averted from the connecting rods 4 and project with their free ends from the lifting guide means 9 which are provided with guide sleeves 12, so that a needleboard beam 13 for receiving a needleboard 1 in a conventional manner can be fastened to the projecting free ends of the guide arms 8. The pivoting adjustment of the couplers 5 about the swiveling axis 10 of the lifting guide means 9 leads to a synchronous cycle of a reciprocating movement in the direction of passage 11 of the non-woven material for the needleboard 1 during a lifting cycle in the direction of needle penetration 6. The swiveling width is determined by the phase angle $\phi$ at constructional conditions that are given otherwise.

In contrast to the embodiment according to FIG. 1, the apparatus according to FIG. 2 shows needleboards 1 which are arranged behind one another in the direction of passage 11 of the non-woven material and whose needleboard beams 13 are directly connected with the couplers 5 of the connecting rods 4. The individual couplers 5 are provided with guide arms 8 which engage in the lifting guide means 9 on the side of the connecting rods 4, so that the couplers 5, at a respective phase angle $\phi$ between the eccentric shafts 2 and 3, are subjected about the swiveling axis 10 of the lifting guide means 9 to a reciprocating pivoting adjustment during a revolution of the eccentric drive. This pivoting adjustment of the couplers 5 leads to a driving of the needleboards 1 both in the direction of needle penetration 6 as well as the direction of passage 11 of the non-woven material in cooperation with the lifting adjustment of the couplers 5 via the eccentric shafts 2 and 3.

It is understood that the invention is not limited to the illustrated embodiments. Therefore it is not necessary to provide any sliding guidance for the guide arm 8 of the couplers. Instead of a sliding guidance, the lifting guide means could also consist of a system of guide rods which act upon the guide arm and which form a pivoting axis fro the guide arm.

The invention claimed is:

1. An apparatus for needling a non-woven material with at least one needleboard which is drivable in a reciprocating manner in the needle-penetration direction as well as in the direction of the passage of the non-woven material, comprising an eccentric drive for the needleboard which comprises two parallel eccentric shafts which are drivable in opposite directions and assume a different angular position, and couplers which connect connecting rods of the two eccentric shafts in an articulated manner and comprise a guide arm which is rigidly connected with the same, and a lifting guide means for the guide arms which forms a swiveling axis for the guide arms which is parallel to the eccentric shafts, characterized in that either the guide arms (8) or the couplers (5) carry the needleboard (1).

2. An apparatus according to claim 1, characterized in that when only one single needleboard (1) is provided the guide arms (8) provided on the side of the couplers (5) which is averted from the connecting rods (4) carry the needleboard 81) at their free ends projecting beyond the lifting guide means (9).

3. An apparatus according to claim 1, characterized in that when two needleboards (1) are provided which are arranged behind one another in the direction of passage (6) of the non-woven material said needleboards (1) are arranged on the side of the couplers (5) which is averted from the connecting rods (4) and the guide arms (8).

* * * * *

UNITED STATES PATENT AND TRADEMARK OFFICE

CERTIFICATE OF CORRECTION

PATENT NO. : 7,107,658 B2
APPLICATION NO. : 11/082774
DATED : September 19, 2006
INVENTOR(S) : Müller It is certified that error appears in the above-identified patent and that said Letters Patent is hereby corrected as shown below:

On the title page item (73),
Should read:
--Textilmaschinenfabrik Dr. Ernst Fehrer Aktiengesellschaft
Leonding, Austria--.

Signed and Sealed this

Twenty-sixth Day of December, 2006

JON W. DUDAS
*Director of the United States Patent and Trademark Office*